US009061169B2

(12) United States Patent
Linsmeier

(10) Patent No.: US 9,061,169 B2
(45) Date of Patent: Jun. 23, 2015

(54) SURROGATE FOAM TEST SYSTEM

(71) Applicant: Oshkosh Corporation, Oshkosh, WI (US)

(72) Inventor: Eric Linsmeier, Larsen, WI (US)

(73) Assignee: Oshkosh Corporation, Oshkosh, WI (US)

( * ) Notice: Subject to any disclaimer, the term of this patent is extended or adjusted under 35 U.S.C. 154(b) by 177 days.

(21) Appl. No.: 13/830,876

(22) Filed: Mar. 14, 2013

(65) Prior Publication Data

US 2014/0262355 A1 Sep. 18, 2014

(51) Int. Cl.

| | |
|---|---|
| ***A62C 2/00*** | (2006.01) |
| ***A62C 37/50*** | (2006.01) |
| ***A62C 27/00*** | (2006.01) |
| ***A62C 5/00*** | (2006.01) |

(52) U.S. Cl.

CPC ..... *A62C 37/50* (2013.01); *A62C 27/00* (2013.01); *A62C 5/002* (2013.01)

(58) Field of Classification Search

CPC ..... A62C 27/00; A62C 31/00; A62C 31/12; A62C 99/0036

USPC ..... 169/44, 45, 46, 14; 239/344, 354, 398, 239/413

See application file for complete search history.

(56) References Cited

U.S. PATENT DOCUMENTS

| | | | | |
|---|---|---|---|---|
| 4,212,908 | A | 7/1980 | Hendy et al. | |
| 5,174,383 | A | 12/1992 | Haugen et al. | |
| 5,232,052 | A | 8/1993 | Arvidson et al. | |
| 5,313,548 | A * | 5/1994 | Arvidson et al. | 388/800 |
| 5,494,112 | A | 2/1996 | Arvidson et al. | |
| RE35,362 | E | 10/1996 | Arvidson et al. | |
| 5,765,644 | A | 6/1998 | Arvidson et al. | |
| 5,881,818 | A | 3/1999 | Lee et al. | |
| 6,588,286 | B1 | 7/2003 | Kudo et al. | |
| 6,615,675 | B1 | 9/2003 | Kudo et al. | |
| 6,715,373 | B2 | 4/2004 | Kudo et al. | |
| 6,739,174 | B2 | 5/2004 | Kudo et al. | |
| 7,080,694 | B2 | 7/2006 | Boyle | |
| 7,143,641 | B2 | 12/2006 | Palazzolo et al. | |
| 7,290,457 | B2 | 11/2007 | Kudo et al. | |
| 7,293,478 | B2 | 11/2007 | Kudo et al. | |
| 7,513,315 | B2 | 4/2009 | Boyle et al. | |
| 7,530,403 | B2 | 5/2009 | Cano | |
| 7,703,543 | B2 | 4/2010 | Waters et al. | |
| 8,103,366 | B2 | 1/2012 | Gamble et al. | |
| 2004/0020262 | A1 * | 2/2004 | Kudo et al. | 73/1.01 |
| 2008/0236846 | A1 | 10/2008 | Gamble et al. | |
| 2010/0065286 | A1 | 3/2010 | Hosfield | |
| 2011/0064591 | A1 | 3/2011 | McLoughlin et al. | |

* cited by examiner

*Primary Examiner* — Davis Hwu
(74) *Attorney, Agent, or Firm* — Foley & Lardner LLP

(57) ABSTRACT

A surrogate foam test system for testing a foam distribution system of a fire fighting vehicle includes a water tank having an outlet coupled to a flush line and a foam storage tank having an outlet coupled to a foam feed line. The water tank provides water through the outlet and the foam storage tank provides a foam fire suppressant. The test system also includes a flush valve coupled to the flush line, where the flush line extends through the flush valve and into the foam feed line at a junction, and a foam valve coupled to the foam feed line before the junction, where the foam feed line extends through the foam valve and accepts the flush line the junction. A flow meter is coupled to the flush line between the flush valve and the junction, where the flow meter is configured to monitor a flow rate of the water within the flush line.

8 Claims, 4 Drawing Sheets

SURROGATE FOAM TEST SYSTEM

BACKGROUND

The present invention relates generally to the field of fire fighting systems, and more specifically to surrogate foam test systems for vehicles having a fire fighting foam distribution system.

Fire fighting vehicles such as Aircraft Rescue Fire Fighting (ARFF) vehicles are specially designed to respond to airport ground emergencies typically involving aircraft. Because such emergencies can occur anywhere on or near airport property, sufficient water and other agents (e.g., foam fire suppressants) must be carried to the emergency site in order to contain a fire and allow for the best possibility of extinguishment.

ARFF vehicles use fire fighting foam systems for extinguishing burning material, such as flammable fuels and liquids. The foam systems utilize water systems to mix and eject foam fire suppressants (e.g., aqueous film forming foam, protein foam, film-forming fluoroprotein foam, alcohol-resistant foam, etc.). Many other types of foam also exist and are likely to be developed. In general, the foam is spread over the surface of a burning material to form a foam "blanket" over the material, which enhances the speed of extinguishment and suppresses volatile vapors and sparks.

Fire fighting foam systems must be tested often to ensure that the systems are operating, and are effective and efficient. Currently, fire fighting guidelines and policies require quarterly and annual AFFF discharge tests on all ARFF vehicles. The foam discharge tests generally verify that the fire fighting foam system of the ARFF is functioning, and ensures that the ARFF's equipment is operational when needed for real-world use. However, during routine testing, significant amounts of AFFF waste water is produced, which can result in environmental damage. Additionally, the toxic foam waste discharged during a test must be contained and transported to a hazardous waste containment facility for treatment, which is a costly process. As an example, a 55 gallon drum of fire fighting foam can range from $500-$1500 USD or more, depending on the particular type of foam.

SUMMARY

One exemplary embodiment relates to a surrogate foam test system for testing a foam distribution system of a fire fighting vehicle. The test system includes a water tank having an outlet coupled to a flush line, where the water tank provides water through the outlet, and a foam storage tank having an outlet coupled to a foam feed line, where the foam storage tank provides a foam fire suppressant. The test system further includes a flush valve coupled to the flush line, where the flush line extends through the flush valve and into the foam feed line at a junction, and a foam valve coupled to the foam feed line before the junction, where the foam feed line extends through the foam valve and accepts the flush line the junction. A flow meter is coupled to the flush line between the flush valve and the junction, where the flow meter is configured to monitor a flow rate of the water within the flush line.

Another exemplary embodiment relates to a fire fighting vehicle having a foam distribution system. The fire fighting vehicle includes a main water tank having an outlet coupled to a flush line, where the main water tank provides water through the outlet, and a foam storage tank having an outlet coupled to a foam feed line, where the foam storage tank provides a foam fire suppressant. The fire fighting vehicle further includes a flush valve coupled to the flush line, where the flush line extends through the flush valve and into the foam feed line at a junction, and a foam valve coupled to the foam feed line before the junction, where the foam feed line extends through the foam valve and accepts the flush line the junction. The fire fighting vehicle further includes a proportioning device coupled to the foam feed line after the junction, where the proportioning device is configured to control a flow rate of fluid therethrough, and an eductor comprising a first inlet coupled to a fluid outlet line from the proportioning device and a second inlet coupled to a water feed line from the main water tank, where the eductor is configured to mix water from the water feed line and fluid from the proportioning device and discharge a mixed fluid. A flow meter is coupled to the flush line between the flush valve and the junction, where the flow meter is configured to monitor a flow rate of the water within the flush line.

Another exemplary embodiment relates to a method of testing a foam distribution system of a fire fighting vehicle. The method includes opening a flush valve coupled to a flush line, where the flush line extends through the flush valve and into a foam feed line at a junction; closing a foam valve coupled to the foam feed line upstream of the junction, where the foam feed line extends through the foam valve and accepts the flush line the junction; feeding water through the flush line from a main water tank having an outlet coupled to the flush line; and monitoring, with a flow meter, the flow rate of the water within the flush line, where the flow meter is coupled to the flush line between the flush valve and the junction.

The invention is capable of other embodiments and of being carried out in various ways. Alternative exemplary embodiments relate to other features and combinations of features as may be generally recited in the claims.

The foregoing is a summary and thus by necessity contains simplifications, generalizations and omissions of detail. Consequently, those skilled in the art will appreciate that the summary is illustrative only and is not intended to be in any way limiting. Other aspects, inventive features, and advantages of the devices and/or processes described herein, as defined solely by the claims, will become apparent in the detailed description set forth herein and taken in conjunction with the accompanying drawings.

BRIEF DESCRIPTION OF THE DRAWINGS

The invention will become more fully understood from the following detailed description taken in conjunction with the accompanying drawings wherein like reference numerals refer to like elements, in which.

DETAILED DESCRIPTION

Figure 1:
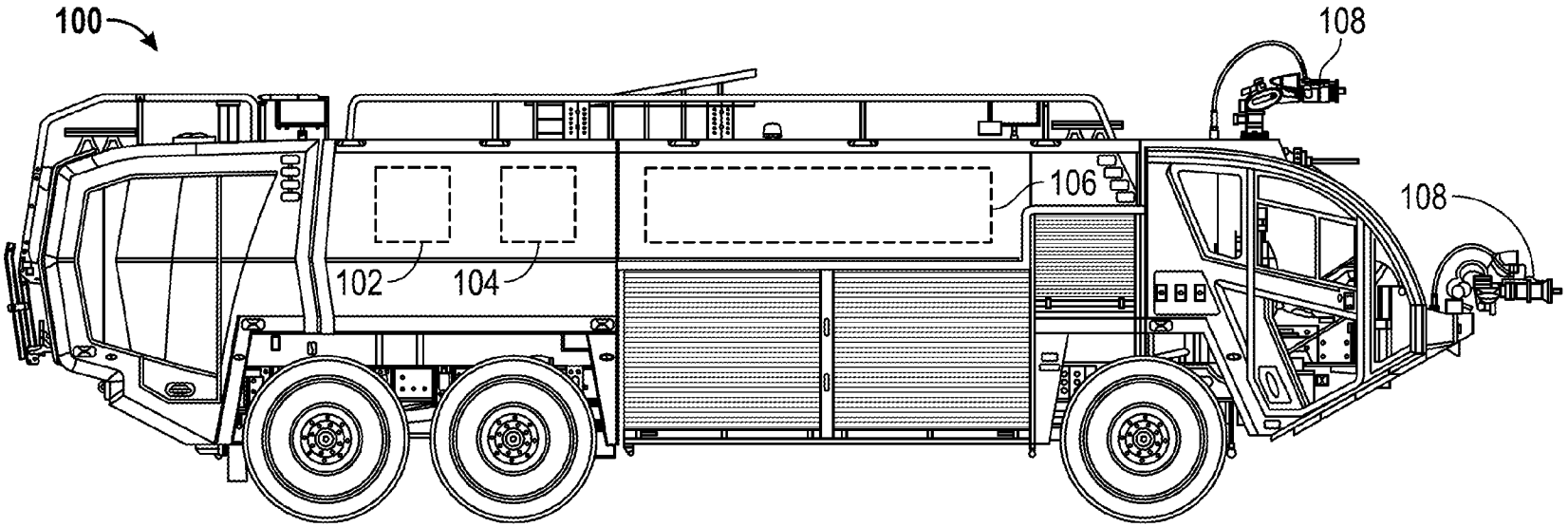
FIG. 1 is a schematic diagram of a fire fighting vehicle having a surrogate foam test system, according to an exemplary embodiment.

Before turning to the figures, which illustrate the exemplary embodiments in detail, it should be understood that the application is not limited to the details or methodology set forth in the description or illustrated in the figures. It should also be understood that the terminology is for the purpose of description only and should not be regarded as limiting.

Referring generally to the figures, various embodiments of a surrogate foam test system are shown and described. Fire fighting vehicles, for example Aircraft Rescue Fire Fighting (ARFF) vehicles, are specialized vehicles that carry water and foam with them to the scene of an emergency. Although the present application generally refers to ARFF vehicles, it should be understood that the scope of this present application encompasses any fire fighting vehicle having a foam distribution system. Most commonly, ARFF vehicles are commissioned for use at an airfield, where the location of an emergency (e.g., an airplane crash) can widely vary, which creates the need of transporting firefighting materials to the emergency site. ARFF vehicles are heavy duty vehicles in nature, and are able to respond at high speeds to reach all parts of an airfield quickly.

ARFF vehicles typically combat fires (e.g., jet fuel fires) with foam distribution systems. These foam distribution systems make use of foam fire suppressants, often aqueous film forming foam (AFFF), although other foam types (e.g., low-expansion foams, medium-expansion foams, high-expansion foams, alcohol-resistant foams, synthetic foams, protein-based foams, and foams to be developed, etc.) may be utilized. The scope of the present application is not limited to a particular type of foam. AFFF is water-based and frequently includes hydrocarbon-based surfactant (e.g., sodium alkyl sulfate, etc.) and a fluorosurfactant (e.g., fluorotelomers, perfluorooctanoic acid, perfluorooctanesulfonic acid, etc.). AFFF has a low viscosity and spreads rapidly across the surface of hydrocarbon fuel fires. An aqueous film forms beneath the foam on the fuel surface that cools burning fuel, and prevents evaporation of flammable vapors and reignition of fuel once it has been extinguished. The film also has a self-healing capability whereby holes in the film layer are rapidly resealed. In use, an AFFF (or other foam) concentrate is stored in a foam tank, and a foam concentrate-to-water ratio is established. The concentrate is mixed with water from a water tank according to the established ratio, thereby forming a foam mixture to be dispensed. The mixed foam is then ejected from the ARFF and applied to a fire.

Because of the low-frequency of airplane accidents (or other accidents requiring the use of an ARFF vehicle), fire fighting foam systems must be tested often to ensure that the systems are still operational when an accident occurs. In extreme cases, an ARFF vehicle's foam system may not be used for years. During testing, fire fighting foam systems often produce large amounts of AFFF waste, which much be properly disposed of by a containment facility. Testing fire fighting foams systems in this manner can be very costly, and often requires the use of additional external testing tanks holding various testing fluids. However, water from the ARFF's water tank may be used (i.e., as the surrogate fluid) during testing by routing the water through the flush line of the ARFF using the systems described herein, resulting in environmentally cleaner and cheaper testing. According to the present disclosure, a flow meter can be used to monitor the rate of water through the flush line. By comparing the water flow rate through the flush line to known passing flow rates for water, the foam system can be confirmed to be operational without the use of additional or remote tanks of testing fluid. The passing flow rate may be based on a flow rate value corresponding to a flow rate through the remainder of the foam system (e.g., the flow rate through a fluid proportioning device which controls the concentrate-to-water ratio, etc.). As a flow rate through such a proportioning device is adjusted, the passing flow rate of water through the flush lines may correspond to the adjusted proportioning device flow rate.

Referring to FIG. 1, a fire fighting ARFF vehicle 100 is shown according to an exemplary embodiment. ARFF vehicle 100 includes internal water tank 102, internal foam tank 104, surrogate foam test system 106, and projection turrets 108. Exemplary ARFF vehicles 100 include the New Striker 6×6, New Striker 4×4, Striker 1500, Striker 3000, and Striker 4500 models manufactured by Oshkosh Corporation. Internal water tank 102 and internal foam tank 104 are generally corrosion and UV resistant polypropylene tanks, although other tank types may be used. Internal water tank 102 stores water or other liquid for mixing with foam as described herein, or for dispensing or testing without mixing with foam. In one embodiment, internal water tank 102 is a 3,000 gallon capacity tank, and internal foam tank 104 is a 420 gallon capacity tank. In another embodiment internal water tank 102 is a 1,500 gallon capacity tank, and internal foam tank 104 is a 210 gallon capacity tank. In another embodiment internal water tank 102 is a 4,500 gallon capacity tank, and internal foam tank 104 is a 630 gallon capacity tank. In another embodiment, there are multiple internal water tanks 102 and multiple internal foam tanks 104. In another embodiment, the tank sizes and requirements are specified by the customer. It should be understood that water and foam tank configurations are highly customizable, and the scope of the present application is not limited to particular size or configuration of internal water tank 102 and internal foam tank 104.

According to the systems described herein, water from water tank 102 may be used as a surrogate fluid and routed through surrogate foam test system 106. Internal foam tank 104 stores a foam fire suppressant (e.g., AFFF) and is connected to the foam distribution system of ARFF vehicle 100. In an exemplary embodiment, surrogate foam test system 106 is part of the foam distribution system of ARFF vehicle 100. The foam distribution system includes various projection turrets 108 for dispensing fire fighting foam and water, depending on the configurations of the system. Although depicted as located at the front of ARFF vehicle 100, projection turrets 108 and projection devices may be located in various locations throughout ARFF vehicle 100. For example, ARFF vehicle 100 may have a roof turret, a bumper turret, hose projection connections, and swing out hose reels, etc. In an exemplary embodiment, projection turret 108 is a roof turret that projects fluid between 375 and 750 gallons per minute. Projection turrets 108 may include non-aspirating or aspirating turrets, and may be controllable via an electric joystick control system. In another exemplary embodiment, projection turret 108 is a bumper turret that projects fluid between 625 and 1,250 gallons per minute. In another embodiment, projection turrets 108 are capable of flow rates up to 1,585 gallons per minute. It should be understood that internal water tank 102, internal foam tank 104, surrogate foam test system 106, and projection turrets 108 are connected by appropriate piping as defined by the specifications of a particular ARFF vehicle 100 model.

Figure 2:
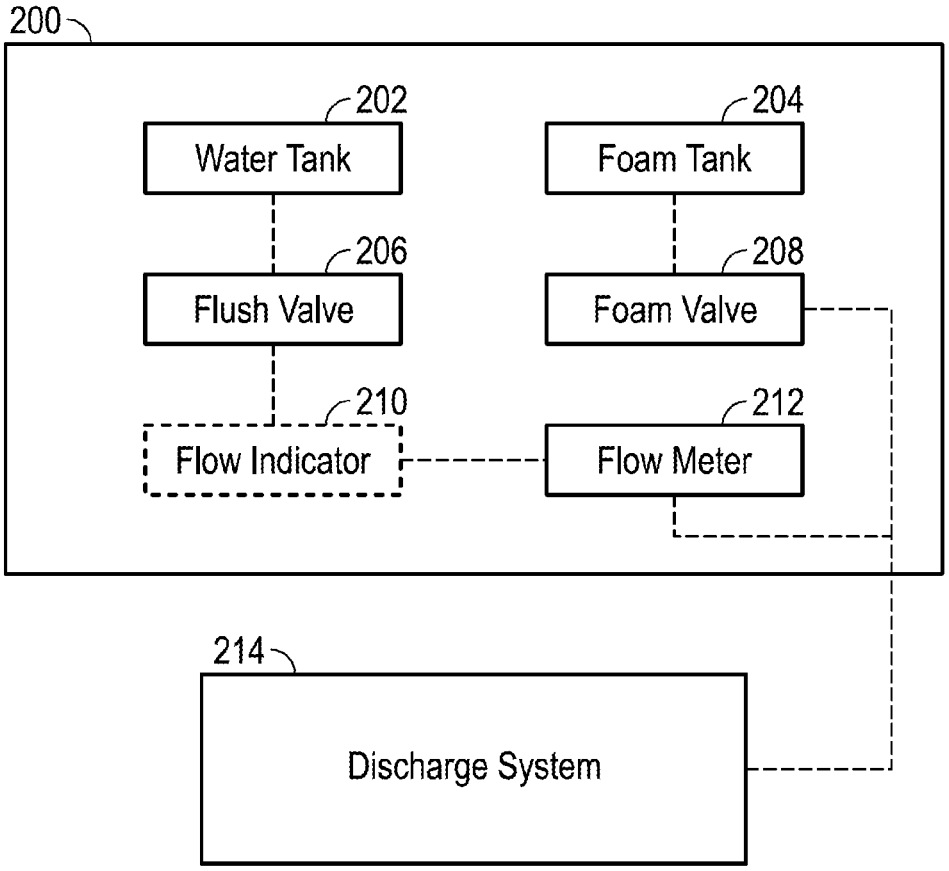
FIG. 2 is a block diagram of a surrogate foam test system for a fire fighting vehicle, according to an exemplary embodiment.

Referring to FIG. 2, a block diagram of surrogate foam test system 200 for a fire fighting vehicle is shown according to an exemplary embodiment. Surrogate foam test system 200 includes water tank 202, foam tank 204, flush valve 206, foam valve 208, flow indicator 210, flow meter 212, and discharge system 214. Although depicted as separate in FIG. 2, in an exemplary embodiment, surrogate foam test system 200 is integrated into discharge system 214. In an exemplary embodiment, water tank 202 is the main water tank of the fire fighting vehicle and may be a water tank as described above.

Foam tank 204 is for storing and dispensing a foam fire suppressant. Flush valve 206 controls the flow of water from water tank 202. In an exemplary embodiment, flush valve 206 is a ball valve. Foam valve 208 controls the flow of foam fire suppressant from foam tank 204. In an exemplary embodiment, flush valve 206 and foam valve 208 are a two-way ball valves, and are controllable by a remote controlling system (e.g., the computing system of the fire fighting vehicle, etc.). As an example, flush valve 206 and foam valve 208 may have a single body, three piece body, split body, top entry, and welded body, etc. Flush valve 206 and foam valve 208 may also include a full port valve, reduced port valve, V-port ball valve, compact ball valve, trunnion ball valve, floating ball valve, and a cavity filler ball valve, etc. Flow indicator 210 includes all components necessary for displaying the flow rate measured by flow meter 212. In an exemplary embodiment, flow indicator 210 is a display of the control system of the fire fighting vehicle (e.g., an LCD display, a monitor, etc.) that is communicably connect to flow meter 212. In another embodiment, flow indicator 210 is a dedicated display device. In yet another embodiment, flow indicator 210 is integrated into flow meter 212. Flow meter 212 includes all components necessary for measuring and quantifying the movement of fluid therethrough. Flow meter 212 may be any device capable of measuring the flow of fluid. For example, flow meter 212 may include a mechanical flow meter, an electronic flow meter, a rotary piston, a gear flow meter, a vortex flow meter, a turbine flow meter, a Venturi meter, an orifice plate, etc. After flowing through surrogate foam test system 200, water from water tank 202 enters the remainder of discharge system 214 of the fire fighting vehicle. In an exemplary embodiment, discharge system 214 is the AFFF foam distribution system as described herein.

Figure 3:
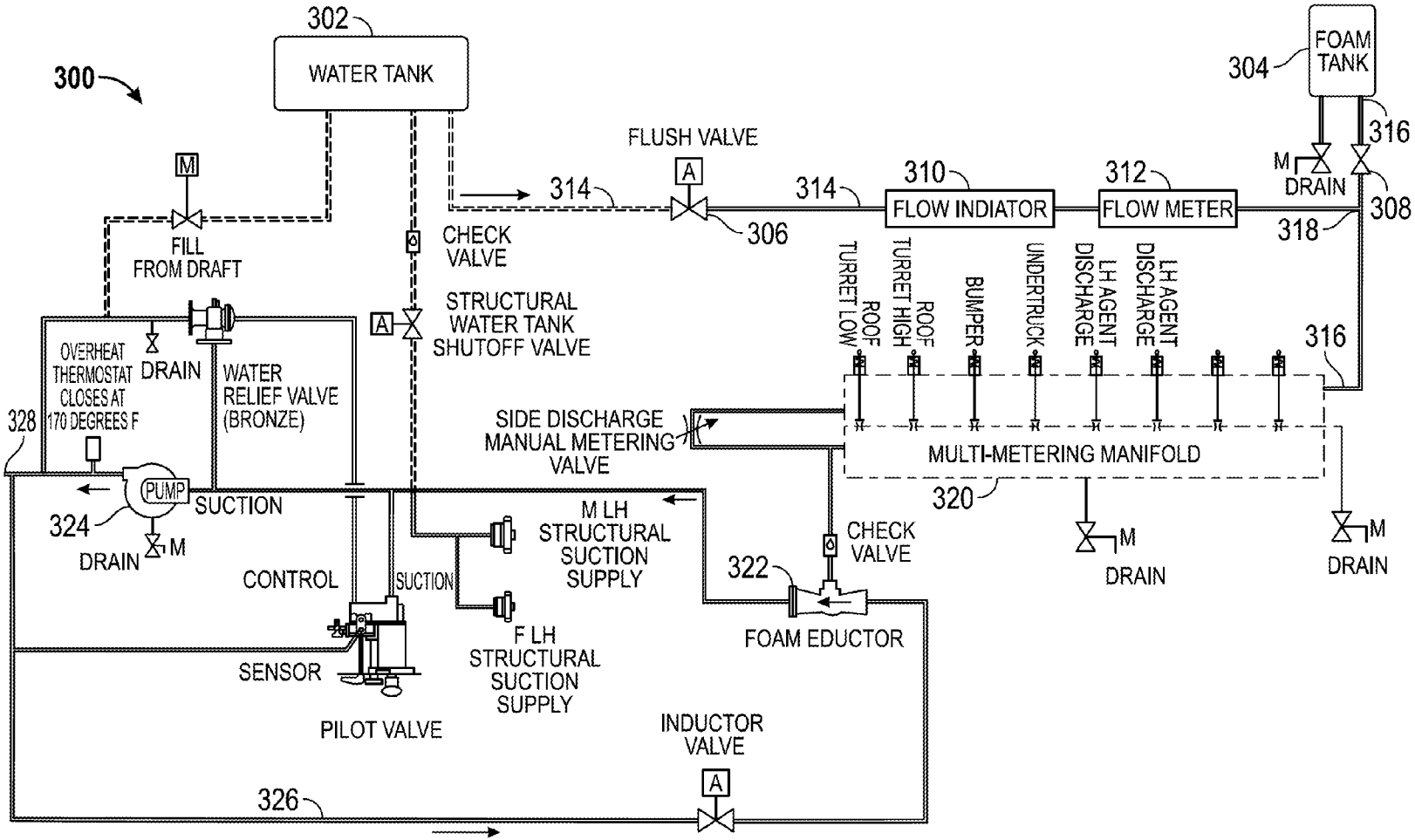
FIG. 3 is a piping diagram of a surrogate foam test system for a fire fighting vehicle, according to an exemplary embodiment.

Referring to FIG. 3, a piping diagram of surrogate foam test system 300 is shown according to an exemplary embodiment. The piping diagram of surrogate foam test system 300 includes various dimensions and notations throughout, which are provided as examples. Surrogate foam test system 300 is generally used to test the operability, effectiveness, and efficiency of a foam distribution system for a fire fighting vehicle (e.g., an ARFF vehicle as discussed above, etc.). Surrogate foam test system 300 is integrated into the overall foam distribution system 328 of the fire fighting vehicle, and includes water tank 302, foam tank 304, flush valve 306, foam valve 308, flow indicator 310, and flow meter 312. Flush line 314 connects to water tank 302 and extends through flush valve 306. Flush line continues into foam line 316 at junction 318. In an exemplary embodiment, junction 328 is a T-junction. Foam line 316 connects to foam tank 304 and extends through foam valve 308. In an exemplary embodiment, foam valve 308 is located upstream of junction 318. Flow meter 312 is integrated to flush line 314 between flush valve 306 and junction 318. Flow indicator 310, although depicted as located between flush line 314 between flush valve 306 and junction 318, may be a communicably connected display device as discussed above, and generally operates in conjunction with flow meter 312. Additional elements of foam distribution system 328 of the vehicle include manifold 320, foam eductor 322, pump 324, and line 326. Foam distribution system 328 may also connect to various outlets (e.g., nozzles, turrets, hoses, etc.) of the fire fighting vehicle, and may contain additional components (e.g., pressure relief valves, safety valves, check valves, pilot valves, temperature sensors, fill and drain ports, lines, pumps, etc.).

In an exemplary embodiment, water tank 302 is coupled to an ARFF vehicle, and stores water as the main water tank of the vehicle. Water tank 302 provides water for mixing with a foam fire suppressant concentrate to create a foam mixture (i.e. a mixture of water and foam concentrate) prior to dispensing. Water tank 302 also provides water as a surrogate fluid to surrogate foam test system 300 during a testing configuration. Water tank 302 has an outlet coupled to flush line 314. In this embodiment, foam tank 304 is also coupled to the ARFF vehicle and stores foam concentrate. Foam tank 304 has an outlet coupled to foam line 316, which is used to provide foam to the ARFF's foam distribution system 328 during an operational configuration.

Testing Configuration of Surrogate Foam Test System

Surrogate foam test system 300 may be set to a testing configuration/mode for testing the operability, efficiency, and effectiveness of the foam distribution system. During the testing configuration of surrogate foam test system 300, flush valve 306 is in an open position, allowing the flow of water from water tank 302. Foam valve 308 is in a closed position, blocking the flow of foam concentrate from foam tank 304. The testing configuration and valve configurations may be remotely activated by a controlling device. For example, the valves may be activated by a servo or solenoid device. Typically, the controlling device is the control computing system of the ARFF vehicle, which allows an operator to switch between various configurations of surrogate foam test system 300 and foam distribution system 328. The controlling device may include graphical displays, human interface and input devices, communication devices, mechanical display devices, etc. Water flows from water tank 302 into flush line 314, through open flush valve 306, and into junction 318. In this manner, the water passes through flow meter 312, which measures the water flow rate. Closed foam valve 308, blocks the flow of water and foam concentrate, and thus the water flows through foam line 316 downstream of junction 318.

The water continues to flow into manifold 320. Manifold 320 may include any fluid proportioning device that generally controls and regulates the flow rate of fluid therethrough. In an operational mode, the fluid is foam concentrate from foam tank 304. By controlling the flow rate of the foam in manifold 320, manifold 320 may establish a foam concentrate-to-water ratio when the foam concentrate reaches eductor 322 after exiting manifold 320. For example, a faster flow rate of foam will result in a higher percentage of foam to water, and a slower flow rate will result in a lower percentage of foam to water. Manifold 320 may make use of various means to control the fluid. In an exemplary embodiment, manifold 320 includes an orifice plate. Such an orifice plate is generally a plate with an opening through it, placed within the stream of flow in order to constrict/regulate the flow to a certain flow rate. The flow rate is dependent on the dimensions of the orifice plate in use. In an exemplary embodiment, manifold 320 includes an orifice plate for each discharge option on the vehicle. The orifice plates can be changed to achieve different foam percentages, and the selection of an orifice plate may be controlled by air cylinders. Each cylinder is synchronized with an air system of the ARFF vehicle. When a turret, preconnect, or other discharge valve is opened, the correct air cylinder opens and allows the proper percentage of foam to flow. However, in the testing configuration, because foam valve 308 is closed and flush valve 306 is open, the fluid flowing through manifold 320 is the water from water tank 302.

The flow rate through a particular orifice plate is known for foam moving at a particular velocity. Similarly, the flow rate of water through the orifice plate is known, or may be calculated by the control system of the vehicle via typical diameter, velocity, viscosity, and flow rate algorithms. Such flow rates may also be stored within the control system. Generally, the known flow rates correspond to proper operational flow rates of foam distribution system 328. By comparing the flow rate of the water through flow meter 312 with a known flow rate through the manifold 320, an operator (or the control system) can confirm that foam distribution system 328 is properly functioning. For example, a particular orifice plate may be selected in manifold 320 for calibration or testing purposes. The orifice plate may have proper operational values ranging from 2 to 5 gallons per minute for a flow of foam concentrate. Due to the less viscous nature of water as compared to foam concentrate, this may correspond to a proper water flow rate range of 10-15 gallons per minute. If the water routed from water tank 302 is able to achieve a passing flow rate at flow meter 312 based on the 10-15 gallons per minute restriction of water flow through manifold 320, foam distribution system 328 may be deemed to be acceptably functioning. The passing flow rate may vary based on a particular orifice plate in use, or according to other variables (such as water pressure, pipe dimensions, manifold types, dimensions of foam distribution system 328, etc.). The flow rate through manifold 320 may also be selected based on a desired passing flow rate or a baseline value (e.g., the configuration value). Additionally, multiple orifice plates may be used simultaneously or sequentially during a test of surrogate foam test system 300. It should be understood, that although the present disclosure refers to manifold 320, embodiments of surrogate foam test system 300 are envisioned that use other fluid proportioning devices (e.g., metering valves, regulators, etc.) that are capable of controlling or otherwise regulating the flow of fluid within a foam distribution system of a fire fighting vehicle.

Also, although the present application discusses the use of water from water tank 302, it is envisioned that other testing liquids may be stored in water tank 302 and used during a testing configuration. In such a circumstance, surrogate foam test system 300 may utilize various known flow rates corresponding to the particular testing liquid in use. For example, a test liquid more similar in viscosity to foam fire suppressant may be utilized during a test. In this scenario, the passing flow rates may by adjusted to correspond to the particular properties of testing liquid in use.

Operational Configuration of Surrogate Foam Test System

Surrogate foam test system 300 may be set to an operational configuration/mode that is typically enabled when the ARFF vehicle is fighting fires. During an operational configuration of surrogate foam test system 300, flush valve 306 is in a closed position, blocking the flow of water from water tank 302 into flush line 314. Foam valve 308 is in an open position, allowing the flow of foam concentrate from foam tank 304 into foam line 316 and through junction 318. Foam concentrate continues to flow through foam line 316 and into manifold 320. After passing through manifold 320 (and passing through a selected orifice plate as described above), the foam concentrate flows at a rate determined by the orifice plate. The foam concentrate continues through a check valve into eductor 322. Eductor 322 mixes the foam concentrate and water from water tank 302 (provided via line 326) to form a foam mixture of a particular consistency. In an exemplary embodiment, the foam concentrate and water mix to form a ratio of approximately three percent foam to water. In another exemplary embodiment, the foam concentrate and water mix to form a ratio of approximately six percent foam to water. Eductor 322 is generally a pump that utilizes a converging-diverging nozzle to convert the pressure energy of the water (i.e. the motive fluid) to velocity energy. This creates a low pressure zone that draws in the foam concentrate (e.g., via the Venturi effect). The foam mixture is discharged by eductor 322 through a line into the inlet side of pump 324. Pump 324 pressurizes and pumps the foam mixture and discharges the mixture throughout the remainder of foam distribution system 328 to be dispensed (e.g., by a roof turret, a bumper turret, or a hose, etc.). Pump 324 may be any water/fluid pump capable of pumping a fluid at a particular pressure and rate.

Figure 4:
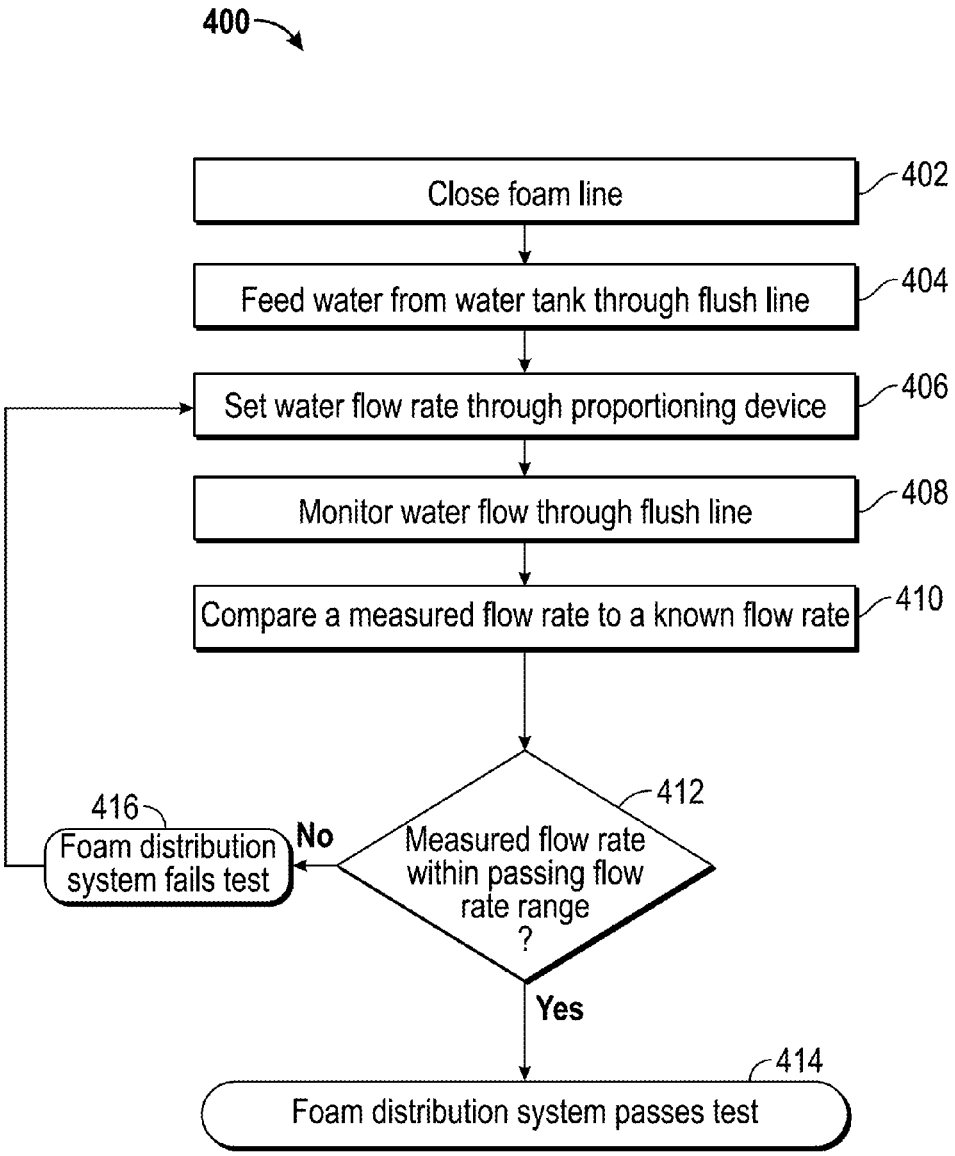
FIG. 4 is a flowchart of a process for testing a foam distribution system, according to an exemplary embodiment.

Referring to FIG. 4, a flow diagram of a process 400 for automatically testing a foam distribution system of a fire fighting vehicle, is shown, according to an exemplary embodiment. In alternative embodiments, fewer, additional, and/or different steps may be performed. Also, the use of a flow diagram is not meant to be limiting with respect to the order of steps performed. Process 400 includes closing the foam feed line (step 402). The foam feed line may be closed by closing the appropriate foam valve. The foam valve may be closed automatically via a control system, or manually, and causes the flow of foam from the foam tank to cease entering the system. Process 400 further includes feeding water from the main water tank of the fire fighting vehicle through a flush line (step 404). This may include opening a flush valve to allow the water to flow into the flush line. The flush valve may be opened automatically via a control system, or may be opened manually. Process 400 further includes regulating the flow rate through a proportioning device (e.g., manifold, metering valves, etc.) of the system (step 406). In an exemplary embodiment, the proportioning device is a manifold. The flow rate may be adjusted by selecting an orifice plate within the proportioning device for a discharge option on the vehicle as described above. Alternatively, the flow rate through the remainder of the foam projection system (including or excluding the proportioning device) may be a known rate dependent on the system dimension and components. Process 400 further includes monitoring water flow through flush line (step 408). A flow meter and flow indicator may be used to monitor and visualize the water flow rate through the flush line. The flow meter may be connected to a computing device capable of logging flow rates. Also, the computing device may maintain statistics and perform analysis related to the water flow rate through the flush line, and related to flow rates throughout the foam projection system. Process 400 further includes comparing measured flow rates of the water through the flush line to a known flow rate (step 410). The known flow rate may include a passing rate range, where a rate within the passing range indicates the foam distribution system has passed the test run, and is acceptably functioning. The known flow rate may also be adjusted or based on the current flow settings corresponding to the remainder of the foam distribution system (e.g., according to the flow rate setting of the proportioning device, dimensions of piping, etc.). Thus, if the measured flow rate of water through the flush line is within a passing flow rate range (step 412), then the foam distribution system is deemed to pass the test, and is ready for use or further tests. If the measured flow rate of water through the flush line is outside a passing flow rate range (step 412), then the foam distribution system is deemed to fail the test, and the foam distribution system may be further tested or repaired, etc. Such further testing may include adjusting flow rates within the foam distribution system (e.g., at the proportioning device), and repeating testing steps described herein.

For purposes of this disclosure, the term "coupled" means the joining of two members directly or indirectly to one another. Such joining may be stationary in nature or moveable in nature and such joining may allow for the flow of electricity, electrical signals, or other types of signals or communication between the two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. For example, methods of monitoring and controlling the flow rate of fluid through the system may be implemented with a software application. Additionally, devices such as a pitot tube and manometer may be configured to monitor the flow rate of fluid through the systems described herein, and may be used in controlling the flow rate of fluid. Monitoring of the flow rate may also include calculations related to flow rate, viscosity, pressure, fluid density, volumes, temperature, etc. Other devices capable of receiving and monitoring flow rate data are also envisioned. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

The construction and arrangements of the surrogate foam test system, as shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. Although the figures may show a specific order of method steps, the order of the steps may differ from what is depicted. Also two or more steps may be performed concurrently or with partial concurrence. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention. All such variations are within the scope of the disclosure. Likewise, software implementations could be accomplished with standard programming techniques with rule based logic and other logic to accomplish the various connection steps, processing steps, comparison steps and decision steps.

What is claimed is:

1. A surrogate foam test system for testing a foam distribution system of a fire fighting vehicle, comprising:

a water tank having an outlet coupled to a flush line, wherein the water tank provides water through the outlet;

a foam storage tank having an outlet coupled to a foam feed line, wherein the foam storage tank provides a foam fire suppressant;

a flush valve coupled to the flush line, wherein the flush line extends through the flush valve and into the foam feed line at a junction;

a foam valve coupled to the foam feed line before the junction, wherein the foam feed line extends through the foam valve and accepts the flush line the junction;

a proportioning device coupled to the foam feed line after the junction, wherein the proportioning device is configured to control a flow rate of water therethrough;

an eductor comprising a first inlet coupled to a fluid outlet line from the proportioning device and a second inlet coupled to a water feed line from the water tank, wherein the eductor is configured to mix water from the water feed line and water from the proportioning device and discharge a mixed fluid; and a flow meter coupled to the flush line between the flush valve and the junction, wherein the flow meter is configured to monitor a flow rate of the water within the flush line.

2. The surrogate foam test system of claim 1, further comprising a flow indicator operably connected to the flow meter, wherein the flow indicator is configured to visually represent the flow rate of the water within the flush line.

3. The surrogate foam test system of claim 1, wherein the flow rate of the water through the proportioning device is adjustable by the proportioning device, such that a measured flow rate by the flow meter is within a range of known flow rate values that correspond to a passing condition of the surrogate foam test system.

4. The surrogate foam test system of claim 1, wherein the foam valve prevents a flow of foam fire suppressant through the foam feed line when the surrogate foam test system is in a testing mode.

5. The surrogate foam test system of claim 1, wherein the flush valve allows a flow of the water through the flush line when the surrogate foam test system is in a testing mode.

6. The surrogate foam test system of claim 1, wherein the flush valve includes a ball valve and the foam valve includes a ball valve.

7. The surrogate foam test system of claim 1, further comprising a fluid pump coupled to an eductor discharge line, wherein the fluid pump pressurizes the mixed fluid from the eductor and discharges a pressurized mixed fluid.

8. The surrogate foam test system of claim 7, further comprising at least one outlet coupled to a fluid pump discharge line, wherein the at least one outlet is configured to eject the pressurized mixed fluid.

* * * * *